US006112566A

United States Patent [19]

Palzer et al.

[11] Patent Number: 6,112,566

[45] Date of Patent: Sep. 5, 2000

[54] ROLLING METHOD FOR ROD-SHAPED ROLLING STOCK, PARTICULARLY ROD STEEL OR WIRE

[75] Inventors: Otmar Palzer, Jüchen; Lutz Broll, Olpe, both of Germany

[73] Assignee: SMS Schloemann-Siemag Aktiengesellschaft, Düsseldorf, Germany

[21] Appl. No.: 09/348,745

[22] Filed: Jul. 6, 1999

[30] Foreign Application Priority Data

Jul. 14, 1998 [DE] Germany ..... 198 31 481

[51] Int. Cl.[7] ..... B21B 37/58

[52] U.S. Cl. ..... 72/10.7; 72/10.6; 72/8.9

[58] Field of Search ..... 72/8.3, 8.9, 9.2, 72/10.4, 10.7, 11.1, 11.2, 11.6, 118, 12.1, 14.4, 14.5, 205, 234

[56] References Cited

U.S. PATENT DOCUMENTS

| | | | |
|---|---|---|---|
| 3,744,288 | 7/1973 | Wykes | 72/11.4 |
| 4,557,126 | 12/1985 | Niino et al. | 72/11.6 |
| 4,909,060 | 3/1990 | Jaquay | 72/10.4 |
| 5,090,224 | 2/1992 | Svagr et al. | 72/14.4 |
| 5,791,182 | 8/1998 | Ciani | 72/11.6 |

*Primary Examiner*—Ed Tolan
*Attorney, Agent, or Firm*—Friedrich Kueffner

[57] ABSTRACT

A method of rolling rod-shaped rolling stock, particularly rod steel or wire, in a roll stand having two work rolls which are adjustable relative to each other in an adjusting direction and which together form a roll groove with an actual roll gap, so that the rolling stock exits the roll stand with an actual height and an actual width at a rolling speed, wherein the rolling stock is rolled with an actual rolling force. The method includes the steps of adjusting the work rolls through a hydraulic cylinder unit; measuring the actual rolling force; measuring with the aid of the actual rolling force a roll gap spring-back resulting from the rolling force; determining with the aid of the roll gap spring-back and a desired roll gap a roll adjustment correction value such that the actual roll gap approaches the desired roll gap; and changing a roll adjustment within a stand control time by the roll adjustment correction value.

15 Claims, 3 Drawing Sheets

ROLLING METHOD FOR ROD-SHAPED ROLLING STOCK, PARTICULARLY ROD STEEL OR WIRE

BACKGROUND OF THE INVENTION

1. Field of the Invention

The present invention relates to a method of rolling rod-shaped rolling stock, particularly rod steel or wire, in a roll stand having two work rolls which are adjustable relative to each other in an adjusting direction and which together form a roll groove with an actual roll gap, so that the rolling stock exits the roll stand with an actual height and an actual width at a rolling speed, wherein the rolling stock is rolled with an actual rolling force.

2. Description of the Related Art

Rolling methods of the above-described type are known in the art. They operate, for example, on the basis of a so-called monitor control. For this purpose, deviations in the height and the width of the rod-shaped rolling stock are measured and controlled on the basis of an electromechanical or hydro-mechanical adjustment. These types of systems have the disadvantage that the monitor control itself as well as the adjustment thereof operate very slowly. Added to this is the time delay caused by the measurement following the last controlled stand. This results in a reaction time of about three seconds, so that only faults having a low frequency can be controlled. Short-term faults, for example, caused by so-called skid marks, cannot be controlled; this may have the result that tolerances are exceeded. The same problem exists in the case of faults which are caused at the beginning of the rolling stock or the end of the rolling stock by temperature or thickness variations.

SUMMARY OF THE INVENTION

Therefore, it is the primary object of the present invention to provide a rolling method for rod-shaped rolling stock which operates much more quickly and which, thus, makes it possible to also control short-term faults.

In accordance with the present invention,

- the work rolls can be adjusted through a hydraulic cylinder unit;
- the actual rolling force is measured;
- a roll gap resilience caused by the rolling force is determined with the aid of the actual rolling force;
- based on the roll gap resilience due to the rolling force and a desired roll gap, a roll adjustment correction value is determined in such a way that the actual roll gap is approximated to the desired roll gap; and
- a roll adjustment is changed within a stand control time by the roll adjustment correction value.

Methods of this type for rolling strip have been generally known for many years. They are highly developed. They ensure independently of the rolling force an actual roll gap which corresponds to the desired roll gap. However, these methods were not considered to be useable for the rolling of rod-shaped rolling stock. The reason for this is that when rolling strip the width of the rolling stock is constant from the outset. In rod-shaped rolling stock, on the other hand, rolling automatically also changes the width of the rolling stock. Consequently, a simple transfer of the method known in connection with rolling strip would result in impermissible width tolerances.

In the method according to the present invention, on the other hand, the method is used for minimizing as quickly as possible the difference between an actual roll gap determined by a control method of a higher order and an actual roll gap. This makes it possible to use the conventional thickness controls now for rod steel and wire trains.

When the rolling stock enters the roll stand with an essentially constant tension, an even greater width and height constancy of the rod-shaped rolling stock results.

For keeping the tension constant, it is provided that the rolling stock is subjected to a tension control in front of the roll stand. The tension control can be constructed especially as a minimum tension control.

The tension control can also be realized, for example, by subjecting the rolling stock to a loop control in front of the roll stand.

In accordance with the present invention, the difference between the actual roll gap and the desired roll gap is compensated in part by the roll adjustment correction value. This is because this causes the cross-section variations of the entering rolling stock to be distributed more uniformly over the actual height and the actual width of the exiting rolling stock. Preferably, the compensation part is dependent on the rolling force and/or the frequency.

The requirements for the control are minimized if

- the work rolls of the roll stand rotate at an operating speed;
- the actual rolling force is measured in accordance with the scanning theorem at least twice during each rotation of the work rolls of the roll stand;
- the roll adjustment correction value is supplied to the roll stand as a sum of frequency components;
- the frequency component corresponding to the operating speed is supplied to the roll stand after a filter time; and
- the work rolls of the roll stand travel during the sum of the stand control time and filter time approximately an odd numbered multiple of half of a rotation.

Rod-shaped rolling stock is rolled in multiple-stand rolling trains. Consequently, the invention particularly relates also to a rolling method in which a rod-shaped rolling stock, particularly rod steel or wire, initially travels through a front roll stand and then a rear roll stand, wherein the front roll stand as well as the rear roll stand are operated with one of the above-described rolling methods, and wherein the adjusting directions of the work rolls of the roll stands extend perpendicularly of each other.

The rolling method can be further improved if

- the actual height and the actual width of the rolling stock are measured at a measuring location following the rear roll stand; and
- the desired roll gaps are determined from a rolling schedule from the actual height and the actual width for the roll stands in such a way that the difference between the actual height and a desired height and the difference between the actual width and a desired width approach zero.

In accordance with a preferred feature, the actual height and the actual width are measured simultaneously.

The rolling method operates even more precisely if the desired roll gaps are supplied to the roll stands time-delayed by a waiting period, wherein the waiting period is determined by the quotient between a rolling stock length existing between the rear and front roll stands and the rolling speed of the front roll stand.

The control dynamics of the above-described rolling method are limited by the rolling stock length existing between the front roll stand and the measuring location for the actual height and the actual width of the rolling stock. Consequently, the control dynamics can be improved even further by determining for the rear roll stand an additional desired roll gap in such a way that the ratio of the relative errors of the height and the width remains as constant as possible, wherein the relative error of the height is a result of the difference between the actual height and the desired height divided by the desired height, and the relative error of the width is a result of the difference between the actual width and the desired width divided by the desired width.

Of course, when determining the desired roll gaps for the roll stands, it is also necessary to take into consideration the influence of the additional desired roll gap on the actual height and the actual width of the rolling stock.

As long as the rolling stock has not yet travelled through the measuring location, the control circuit for determining the desired roll gaps is not closed. Consequently, during the rolling of rolling stock, preadjustments for the roll stands are determined from the actual height, the desired height, the actual width and the desired width. With these preadjustments as control values, it is then possible to roll a subsequent rolling stock until the front end of the subsequent rolling stock travels through the measuring location and closes the control circuit in this manner. It is also possible to operate the roll stands even after closing of the control circuit with the preadjustments as precontrol values.

The dynamics and also the control accuracy of the roll stands are completely provided only if the roll adjustments of the roll stands remain within a predetermined adjustment range. Accordingly, a desired roll gap is determined from the roll adjustments of the roll stands for at least one roll stand arranged in front of the front roll stand. This makes it possible to ensure that the roll adjustments of the two roll stands remain within the most favorable adjustment range.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
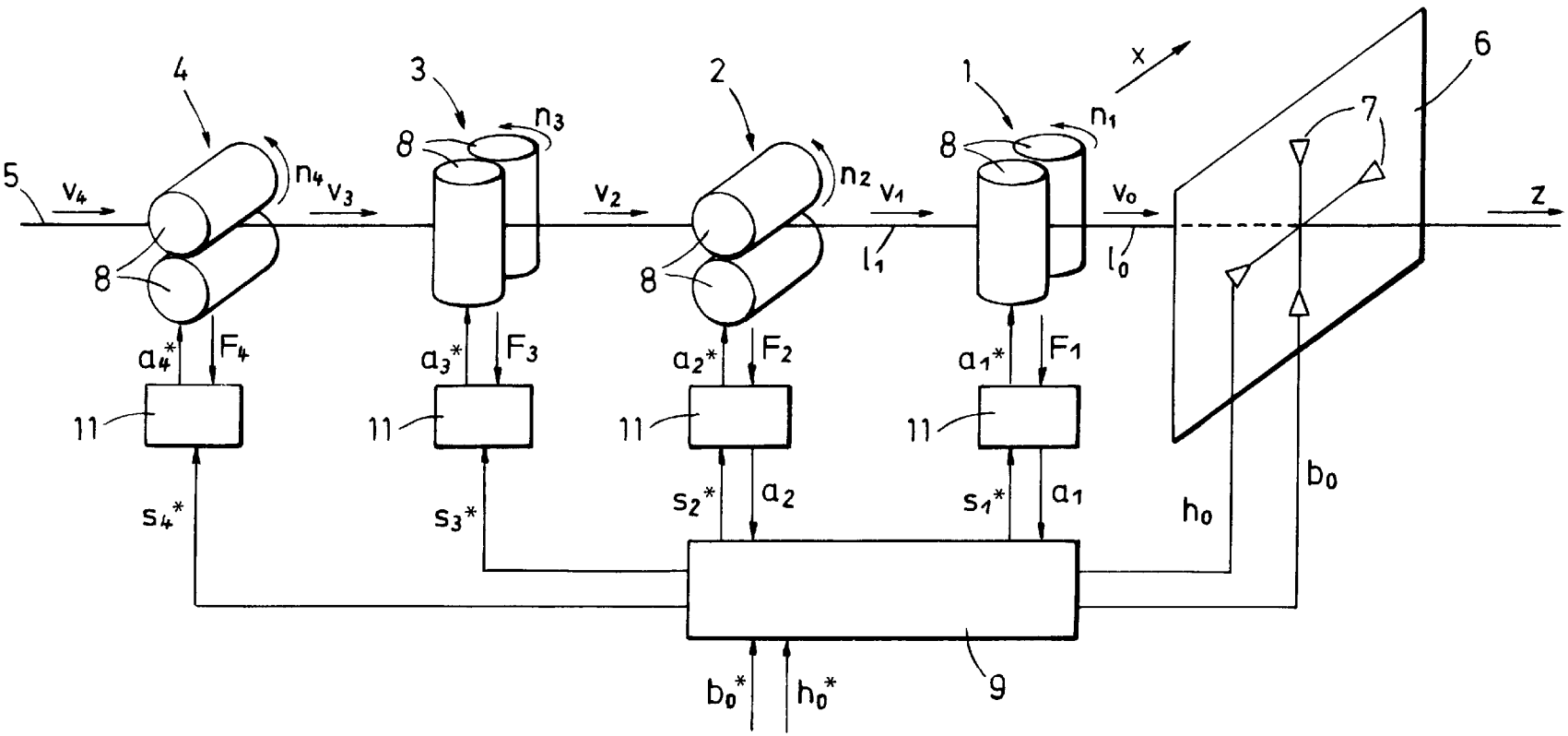
FIG. 1 is a schematic illustration of a multiple-stand wire rolling train.

A rolling train for rod-shaped rolling stock, for example, rod steel or wire, usually has several roll stands. FIG. 1 of the drawing shows four of these roll stands, wherein these roll stands are provided with reference numerals 1 to 4. In accordance with the embodiment, a rod-shaped rolling stock 5 in the form of preliminary material for wire of steel, travels in a conveying direction z successively first through the roll stand 4, then the roll stand 3, then the roll stand 2 and finally the roll stand 1. Following the roll stand 1, a thickness measuring device 7 is arranged at a measuring location 6. Rolling stock lengths $l_0$, $l_1$, of the rolling stock 5 exist between the roll stand 1 and the measuring location 6 and between the roll stand 1 and the roll stand 2, respectively.

The roll stands 1 and 3 are vertical stands. In these roll stands, the two work rolls 8 are arranged vertically. Consequently, work rolls 8 are adjustable relative to each other in an adjusting direction x. The adjusting direction x extends horizontally. On the other hand, the roll stands 2 and 4 are horizontal stands. In these stands, the two work rolls 8 are adjustable in an adjusting direction y which extends vertically.

The adjusting directions x, y form together with the conveying direction z of the rolling stock 5 a right-handed, right-angled system of coordinates x, y, z.

The rolling stock 5 travels into the roll stand 4 at a rolling speed $v_4$, wherein the rolling stock 5 has prior to rolling in the roll stand 4 a dimension $x_4$ in the x-direction and $y_4$ in the y-direction.

The rolling stock 5 is rolled in the roll stand 4, wherein the work rolls 8 of the roll stand 4 rotate with an operating speed $n_4$. After rolling in roll stand 4, the rolling stock 5 leaves the roll stand 4 with a rolling speed $v_3$. At this point in time, the rolling stock 5 has the dimensions $x_3$ and $y_3$ in the x-direction and the y-direction, respectively. The rolling stock enters the roll stand 3 with these values.

Analogously, the rolling stock has between the roll stands 3 and 2 a rolling speed $v_2$ and dimensions $x_2$, $y_2$ in the x-direction and the y-direction. Also, the rolling stock 5 has between the roll stands 2 and 1 a rolling speed $v_1$ and dimensions $x_1$, $y_1$. The rolling stock then exits the roll stand 1 at a rolling speed $v_0$ and with dimensions $x_0$, $y_0$.

As already mentioned, the roll stands 2 and 4 are horizontal stands. In these stands, the dimensions $y_1$, $y_3$ of the exiting rolling stock 5 in the y-direction corresponds to the actual height. The dimensions $x_1$, $x_3$ of the exiting rolling stock 5 correspond to the actual width. In the roll stands 1 and 3, the opposite is the case. In that case, the dimensions $x_0$, $x_2$ correspond to the actual height following the respective roll stand 1 and 3, and the dimensions $y_0$, $y_2$ correspond to the actual width.

The two work rolls 8 of each roll stand 1 to 4 form a roll groove with an actual roll gap $s_1$ to $s_4$. The actual roll gaps $s_1$ to $s_4$ are adjustable by an appropriate adjustment $a_1$ to $a_4$ of the respective roll stand 1 to 4 to a corresponding desired roll gap $s_1^*$ to $s_4^*$. The work rolls 8 of the roll stands 1 and 2 are adjustable relative to each other through hydraulic cylinder units 12. The roll stands 3 and 4 can also be adjustable through hydraulic cylinder units. Alternatively, it is also possible in the roll stands 3 and 4 to adjust these stands through an electric motor or hydraulic motor with subsequent gear unit.

When the beginning of the rolling stock 5 enters the roll stands 1 to 4, it is not possible to determine actual values of the rolling stock 5 in the measurement location 6. Accordingly, the roll stands 1 to 4 are initially operated in a controlled operation with desired roll gaps $s_1^*$ to $s_4^*$. However, as soon as the beginning of the rolling stock 5 travels through the measuring location 6, the thickness measurement device 7 simultaneously measures the actual height $h_0=x_0$ and the actual width $b_0=y_0$ of the rolling stock 5. The values $h_0$, $b_0$ are sent to a rolling schedule computer 9 which determines from these values with the aid of a rolling schedule the desired roll gaps $s_1^*$, $s_2^*$ for the roll stands 1 and 2. Of course, the computation of the desired values $s_1^*$, $s_2^*$ takes into consideration the coupling of the length changes, height changes and width changes in the roll stands 1 and 2. The desired values $s_1^*$, $s_2^*$ are determined in such a way that the difference between the actual height $h_0$ and a desired height $h_0^*$ and a difference between the actual width $b_0$ and a desired width $b_0^*$ approach zero.

A rolling stock length $l_1$ exists between the roll stands 1 and 2. Consequently, a point of the rolling stock 5 which is rolled at a given period of time by the roll stand 2 requires a travel time $t=l_1:v_1$ in order to reach the roll stand 1. Consequently, to have the determined desired roll gaps $s_1^*$ and $s_2^*$ applied to the same point of the rolling stock 5, the desired roll gaps $s_1^*$, $s_2^*$ must be supplied to the roll stands 1, 2 time-delayed by a waiting period which is identical to the travel time t. Accordingly, the desired roll gap $s_2^*$ is supplied to a roll stand 2 earlier than the desired roll gap $s_1^*$ is supplied to the roll stand 1, wherein the time difference is the travel time t.

The rolling stock 5 is rolled in the roll stands 1 to 4 with actual rolling forces $F_1$ to $F_4$. As a result of the actual rolling forces $F_1$ to $F_4$, the actual roll gaps $s_1$ to $s_4$ of the roll stands 1 to 4 spring back. Consequently, the actual roll gaps $s_1$ to $s_4$ result as a sum of an adjustment $a_4$ to $a_1$ of the respective roll stand 1 to 4 and the respective stand resilience or spring back capability $C_1F_1$ to $C_4F_4$. $C_1$ to $C_4$ are the spring constants of the roll stands 1 to 4.

Figure 2:
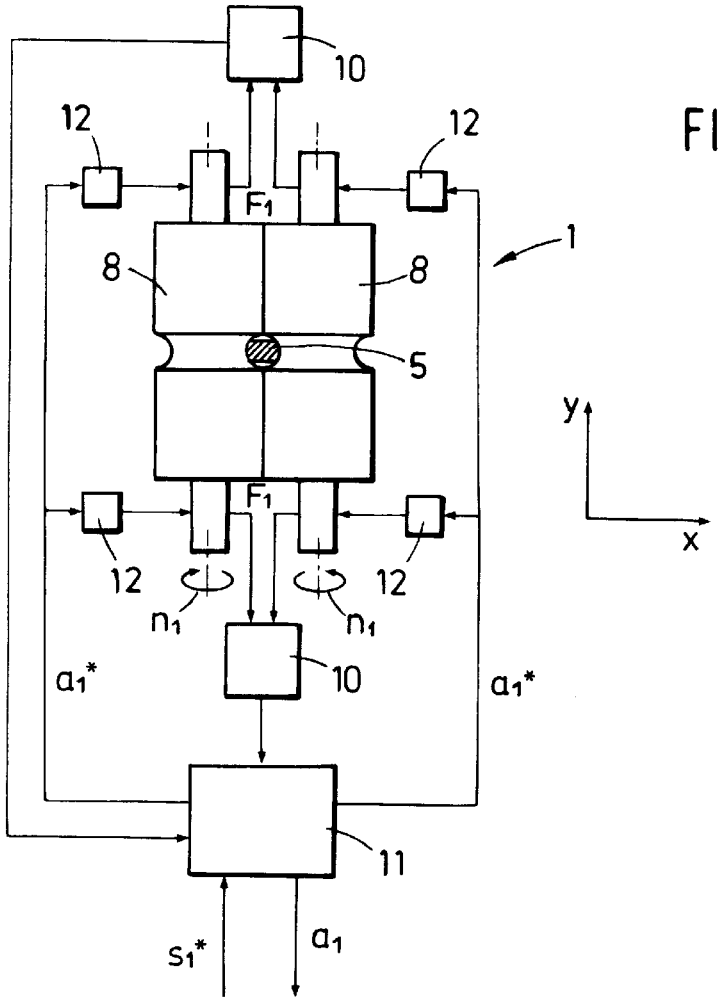
FIG. 2 is a schematic illustration of a vertical roll stand.
Figure 3:
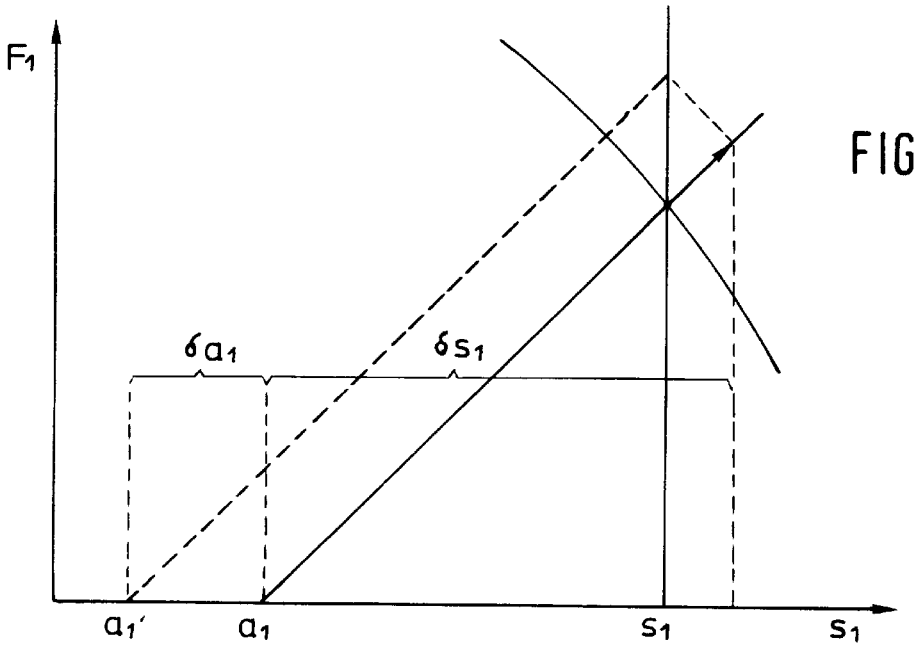
FIG. 3 is a force/roll gap diagram.

In order to maintain the actual roll gap $s_1$ of the roll stand 1 at its desired roll gap $s_1^*$, the actual rolling force $F_1$ is measured and supplied to a frequency filter 10, as shown in FIG. 2. The frequency filter 10 filters the rolling force $F_1$ and supplies the filtered value to a stand controller 11. As illustrated in FIG. 3, the stand controller 11 determines with the aid of the filtered actual rolling force $F_1$ a roll gap spring-back $\delta s_1$ caused by the rolling force. Using this roll gap spring-back $\delta s_1$ and the desired roll gap $s_1^*$, the stand controller 11 then determines a roll adjustment correction value $\delta a_1$ for the roll adjustment $a_1$, so that the actual roll gap $s_1$ is approximated to the desired roll gap $s_1^*$. The stand controller 11 then supplies the sum of the previous desired adjustment $a_1^*$ and roll adjustment correction value $\delta a_1$ as the new desired adjustment $a_1'$ to the hydraulic cylinder units 12 which are used to change the roll adjustment $a_1$ by the roll adjustment correction value $\delta a_1$. The change of the roll adjustment $a_1$ takes place within a stand control time T of about 30 ms. After stand control time T, the actual roll gap $s_1$ is then again adjusted to the desired roll gap $s_1^*$, so that the rolling stock 5 leaves the roll stand 1 with the desired height $h_0^*$ and the desired width $b_0^*$.

The height $h_0$ and the width $b_0$ of the rolling stock 5 not only depend on the rolling force $F_1$ and the adjustment $a_1$ of the roll stand 1, but also on the tension with which the rolling stock 5 enters the roll stand 1 and exits the roll stand 1. In order to eliminate tension variations which would result in height and width variations, the rolling stock 5 is subjected to a tension control in front of the roll stand 1. The tension control is preferably constructed as a minimum tension control. For example, the control can be realized by means of a loop control. The tension control makes it possible that the rolling stock 5 enters the roll stand 1 with an essentially constant tension. The maximum permissible tension variations are 5 MPa. It is even better if the tension variations can be limited to 2 MPa.

When the roll gap control is operated at its full extent, the above-described method makes it possible to maintain the actual roll gap $s_1$ always at a desired roll gap $s_1^*$. However, the rolling force $F_1$ is also dependent on the temperature and the cross-section of the entering rolling stock, and on other parameters. If the stand controller 11 were to control the actual roll gap $s_1$ always to its desired roll gap $s_1^*$, the actual height $h_0$ would always be equal to the desired height $h_0^*$. However, the actual width $b_0$ would vary significantly. Consequently, the control is carried out more advantageously if the difference between the actual roll gap $s_1$ and the desired roll gap $s_1^*$ is compensated only in part by the stand controller 11 by means of the roll adjustment correction value $\delta a_1$. This part usually is between 20 and 90% of the full correction. This part may be in particular dependent on the rolling force and the frequency. When carrying out an only partial correction in this manner, the rolling error is distributed more uniformly over both dimensions $h_0$, $b_0$.

The rolling speed $v_4$ to $v_0$ increases steadily form the roll stand 4 to the roll stand 1. On the other hand, the diameters of the work rolls 8 either remain the same or decrease from the roll stand 4 toward the roll stand 1. This means that the work rolls 8 of the roll stand 1 rotate at the highest speed. Accordingly, any periodic errors caused by eccentricities of the work rolls 8 can at most have a frequency which corresponds to the speed $n_1$ of the roll stand 1. Consequently, in accordance with the scanning theorem, the actual rolling force $F_1$ of the roll stand 1 is measured at least twice during each rotation of the work rolls 8 of the roll stand 1. The roll adjustment correction value $\delta a_1$ is frequency-filtered in the stand controller 11 in accordance with the known frequencies corresponding to the speeds $n_1$ to $n_4$. Only the frequency-filtered roll adjustment correction value $\delta a_1$ is then supplied to the roll stand 1.

The control of the eccentricities is particularly effective if the roll adjustment correction value $\delta a_1$ is supplied to the roll stand 1 as a sum of frequency components. The frequency component corresponding to the operating speed $n_1$ of the roll stand 1 is supplied to the roll stand 1 after a filter time T'. This frequency component can then be weighted, possibly with its own amplification factor of between 0.15 and 10.0, relative to the other frequency components. The filter time T' is selected in such a way that the work rolls 8 of the roll stand 1 travel during the sum of the stand control time T and filter time T' between 0.4 and 0.55 rotations, i.e., approximately one half rotation, possibly in addition to any number of full rotations.

Figure 4:
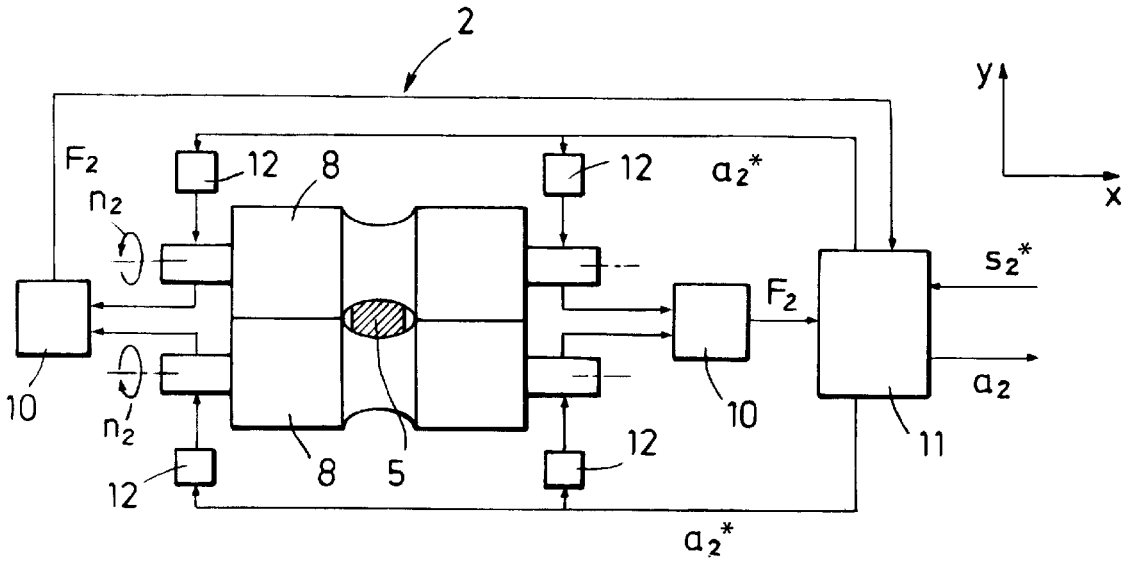
FIG. 4 is a schematic view of a horizontal roll stand.

The roll stand 2 according to FIG. 4 is controlled in the same manner as roll stand 1.

The rolling stock length $l_1$ exists between the roll stands 1 and 2. The rolling stock length $l_0$ exists between the roll stand 1 and the measuring location 6. Consequently, the dynamics of the monitor control are limited by the sum of $l_1:v_1+l_0:v_0$. Faster faults cannot be controlled by means of the above-described method.

If, on the other hand, only the roll stand 1 were controlled, the maximum control dynamics of the monitor control would be represented by $l_0:v_0$. Consequently, the control dynamics would be higher. This can be utilized by determining for the roll stand 1 an additional desired roll gap $\delta s^*$. This value is determined in such a way that the ratio of the relative errors $\delta h$, $\delta b$ with respect to height and width of the rolling stock 5 remains constant, or at least in all cases within a preselectable limit. The relative error $\delta h$ with respect to the height is a result of the difference of the actual height $h_0$ and desired height $h_1^*$ divided by the desired height $h_0^*$. The relative error $\delta b$ with respect to the width analogously is a result of the difference of the actual width $b_0$ and the desired width $b_0^*$ divided by the desired width $b_0^*$. Of course, the influence of the additional desired roll gap $\delta s_1^*$ on the actual height $h_0$ and the actual width $b_0$ must be taken into consideration when determining the desired roll gaps $s_1^*$, $s_2^*$ for the roll stands 1 and 2.

Of course, the method described above for adjusting the desired roll gaps $s_1^*$, $s_2^*$ can only be carried out when the beginning of the rolling stock 5 has already reached or passed the measuring location 6, i.e., the monitor control is closed. Before this point in time, the control circuit is open. Accordingly, the roll stands 1, 2 must be operated during this period of time in a controlled operation. However, from measurements of the actual height $h_0$ the actual width $b_0$ and the corresponding desired values $h_0^*$, $b_1^*$, those desired roll gaps $s_1^*$, $s_2^*$ at which the desired actual values $h_0$, $b_0$ can be expected can be determined in the rolling schedule computer 9 with the aid of a rolling model. The roll stands 1, 2 are then operated with these values for the desired roll gaps $s_1^*$, $s_2^*$ as long as the control circuit of the monitor control is open.

The roll stands 1, 2 can be operated in an optimum manner only within a predetermined adjustment range. In order to always ensure that the actual adjustments $a_1$, $a_2$ of the roll stands 1, 2 remain within this range, the actual adjustments $a_1$, $a_2$ of the roll stands 1, 2 are transmitted to the rolling schedule computer 9. As soon as the actual adjustments $a_1$, $a_2$ reach the limits of their permissible ranges, the desired roll gaps $s_3$*, $s_4$* of the roll stands 3, 4 are changed in such a way that the actual adjustments $a_1$, $a_2$ of the roll stands 1, 2 are once again shifted toward the middle of the permissible dynamic range. Accordingly, new desired roll gaps $s_3$*, $s_4$* are determined for the upstream roll stands 3, 4 from the roll adjustments $a_1$, $a_2$ of the roll stands 1, 2.

The rolling method according to the present invention makes it possible to achieve accuracies in wire and rod steel trains which have previously not been attained. In particular, the oval shape of the rolling stock 5 at the exit of the rolling train can be reduced to a quarter of the value permitted by ASTM-A29.

While specific embodiments of the invention have been shown and described in detail to illustrate the inventive principles, it will be understood that the invention may be embodied otherwise without departing from such principles.

We claim:

1. A method of rolling rod-shaped rolling stock, particularly rod steel or wire, in a roll stand having two work rolls, wherein the work rolls are adjustable relative to each other in an adjusting direction by a hydraulic cylinder unit, and wherein the work rolls together form a roll groove with an actual roll gap, and wherein the rolling stock exits the roll stand with an actual height and an actual width and at a rolling speed, the method comprising rolling the rolling stock with an actual rolling force;

measuring the actual rolling force;

measuring with the aid of the actual rolling force a roll gap spring-back resulting from the rolling force;

determining with the aid of the roll gap spring-back and a desired roll gap a roll adjustment correction value such that the actual roll gap approaches the desired roll gap; and changing a roll adjustment within a stand control time by the roll adjustment correction value.

2. The roll method according to claim 1, comprising conducting the rolling stock into the roll stand with an essentially constant tension.

3. The rolling method according to claim 2, comprising subjecting the rolling stock to a tension control in front of the roll stand.

4. The rolling method according to claim 3, comprising using a minimum tension control as the tension control.

5. The rolling method according to claim 3, comprising subjecting the rolling stock to a loop control in front of the roll stand.

6. The rolling method according to claim 1, comprising compensating a difference between the actual roll gap and the desired roll gap in part by the roll adjustment correction value.

7. The rolling method according to claim 6, wherein the part is dependent on at least one of the rolling force and a frequency.

8. The rolling method according to claim 1, further comprising;

rotating the work rolls of the roll stand with an operating speed;

measuring the actual rolling force at least twice during each rotation of the work rolls of the roll stand;

supplying the roll adjustment correction value to the roll stand as a sum of frequency components;

supplying a frequency component corresponding to the operating speed to the roll stand after a filter time; and selecting a stand control time such that the work rolls of the roll stand travel during a sum of the stand control time and the filter time approximately an odd numbered multiple of half a rotation.

9. A method of rolling rod-shaped rolling stock, particularly rod steel or wire, in a front roll stand and in a rear roll stand, each roll stand having two work rolls, wherein the work rolls are adjustable relative to each other in an adjusting direction through a hydraulic cylinder unit, wherein the work rolls together form a roll groove with an actual roll gap, and wherein the rolling stock exits each roll stand with an actual height and an actual width at a rolling speed, and wherein the adjustment directions of the work rolls of the front roll stand and of the rear roll stand extend perpendicularly of each other, the method comprising carrying out in each roll stand the steps of rolling the rolling stock with an actual rolling force;

measuring the actual rolling force;

measuring with the aid of the actual rolling force a roll gap spring-back resulting from the rolling force;

determining with the aid of the roll gap spring-back and a desired roll gap a roll adjustment correction value such that the actual roll gap approaches the desired roll gap; and changing a roll adjustment within a stand control time by the roll adjustment correction value.

10. The rolling method according to claim 9, further. comprising the steps of measuring the actual height and the actual width of the rolling stock at a measuring location following the rear roll stand; and determining from the actual height and the actual width and from a rolling schedule the desired roll gaps such that a difference between the actual height and a desired height and a difference between the actual width and a desired width approach zero.

11. The rolling method according to claim 10, comprising simultaneously measuring the actual height and the actual width.

12. The rolling method according to claim 10, comprising supplying the desired roll gaps to the roll stands time-delayed by a waiting period, wherein the waiting time is determined by a quotient between a rolling stock length existing between the rear roll stand and the front roll stand and the rolling speed of the front roll stand.

13. The rolling method according to claim 12, comprising determining for the rear roll stand an additional desired roll gap such that a ratio of a relative error with respect to height and width remains as constant as possible, wherein the relative error with respect to the height is determined by a difference of the actual height and the desired height divided by the desired height, and the relative error with respect to the width is determined by a difference of the actual width and the desired width divided by the desired width.

14. The rolling method according to claim 10, comprising determining desired roll gaps for the roll stands for the actual height, the desired height, the actual width and the desired width.

15. The rolling method according to claim 10, comprising determining a desired roll gap of at least one roll stand arranged upstream of the front roll stand from the roll adjustments of the front roll stand and the rear roll stand.

* * * * *